US012385730B2

(12) United States Patent
Jensen et al.

(10) Patent No.: US 12,385,730 B2
(45) Date of Patent: Aug. 12, 2025

(54) GEOMETRIC EXPLOSIVE CHARGES AND RELATED METHODS

(71) Applicant: Dyno Nobel Inc., Salt Lake City, UT (US)

(72) Inventors: David Scott Jensen, Salt Lake City, UT (US); David Lynn Gordon, West Jordan, UT (US)

(73) Assignee: Dyno Nobel Inc., Salt Lake City, UT (US)

( * ) Notice: Subject to any disclaimer, the term of this patent is extended or adjusted under 35 U.S.C. 154(b) by 10 days.

(21) Appl. No.: 18/342,393

(22) Filed: Jun. 27, 2023

(65) Prior Publication Data

US 2024/0159506 A1 May 16, 2024

Related U.S. Application Data

(60) Provisional application No. 63/367,451, filed on Jun. 30, 2022, provisional application No. 63/367,453, filed on Jun. 30, 2022.

(51) Int. Cl.
*F42D 1/10* (2006.01)
*F42D 3/04* (2006.01)

(52) U.S. Cl.
CPC *F42D 1/10* (2013.01); *F42D 3/04* (2013.01)

(58) Field of Classification Search
CPC ..... F42B 1/10; F42B 1/20; F42B 3/04; C06B 47/14; F42D 1/10; F42D 1/20; F42D 3/04
USPC ..... 102/313
See application file for complete search history.

(56) References Cited

U.S. PATENT DOCUMENTS

| | | | | |
|---|---|---|---|---|
| 4,662,451 | A * | 5/1987 | Boade | E21B 43/263 166/308.1 |
| 5,071,496 | A | 12/1991 | Coursen et al. | |
| 9,879,965 | B2 * | 1/2018 | Zank | C06B 23/003 |
| 9,989,344 | B2 * | 6/2018 | Zank | F42D 1/10 |
| 10,557,575 | B2 * | 2/2020 | Morton | F15D 1/02 |
| 2006/0137560 | A1 | 6/2006 | Robert | |
| 2016/0145165 | A1 * | 5/2016 | Zank | F42D 3/04 149/109.6 |
| 2016/0146587 | A1 | 5/2016 | Zank et al. | |
| 2020/0249001 | A1 | 8/2020 | Halander et al. | |
| 2021/0148689 | A1 | 5/2021 | Averett et al. | |

FOREIGN PATENT DOCUMENTS

| | | | | |
|---|---|---|---|---|
| WO | WO-2024081454 A2 * | 4/2024 | ..... | F42D 1/10 |

OTHER PUBLICATIONS

International Search Report and Written Opinion dated Jun. 12, 2024 for PCT/US2023/069190.

* cited by examiner

*Primary Examiner* — James S Bergin
(74) *Attorney, Agent, or Firm* — Dorsey & Whitney LLP

(57) ABSTRACT

Approaches to loading explosives into blast holes to provide increased explosive density can involve loading the hole with a detonable charge in which energetic material is arranged into zones of differing densities. Related systems and methods may provide for parallel independent streams of energetic material having differing densities and delivering the differentiated streams into a bore hole so as to create an explosive charge therein having a particular geometric arrangement of material from the respective streams.

18 Claims, 11 Drawing Sheets

GEOMETRIC EXPLOSIVE CHARGES AND RELATED METHODS

RELATED APPLICATIONS

This application claims priority to U.S. Provisional Application No. 63/367,453, filed Jun. 30, 2022, titled GEOMETRIC EXPLOSIVE CHARGES AND RELATED METHODS, and U.S. Provisional Application No. 63/367,451, filed Jun. 30, 2022, titled SYSTEMS FOR LOADING EXPLOSIVES INTO BLAST HOLES, each of which is incorporated herein by reference in its entirety.

FIELD OF THE INVENTION

The present disclosure relates generally to explosives. More specifically, the present disclosure relates to methods and systems for loading explosives into blast holes to provide increased explosive density. However, it will be appreciated that the invention is not limited to this particular field of use.

Any discussion of the prior art herein is provided to place the invention in an appropriate technical context and enable the advantages of it to be more fully understood. It should be appreciated, however, that any discussion of the prior art throughout the specification should not be considered as an express or implied admission that such prior art is widely known or forms part of the common general knowledge in the field.

It is an object of the present invention to overcome or ameliorate one or more the disadvantages of the prior art, or at least to provide a useful alternative.

BRIEF DESCRIPTION OF THE DRAWINGS

To easily identify the discussion of any particular element or act, the most significant digit or digits in a reference number refer to the figure number in which that element is first introduced.

DETAILED DESCRIPTION

Figure 1A:
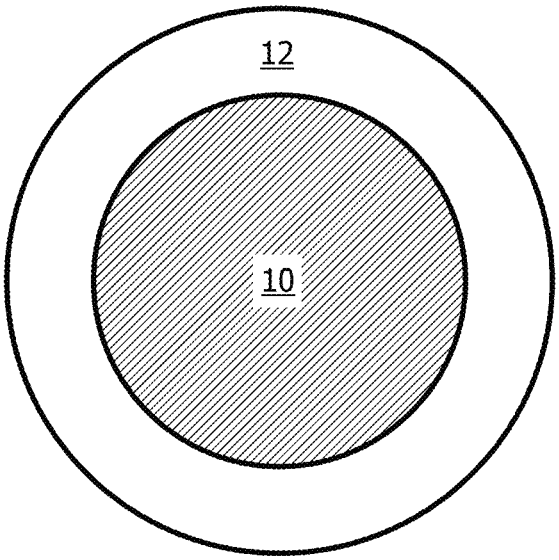
FIG. 1A is a cross-section diagram illustrating the geometry of an explosive charge in accordance with an embodiment.

Bulk explosives are commonly used in mining, quarrying, and excavation for breaking rocks and ore. Generally, a hole, referred to as a "bore hole" or "blast hole," is drilled into a surface such as the ground or a rock face. Bulk explosives are delivered into the bore hole, typically along with a primer, where they can be triggered to detonate as part of a blast sequence. Approaches to increasing effectiveness in blasting applications can include deploying explosives in blast holes so as to increase the amount of rock affected by each blast. This object can be stated in terms of increasing the blast energy of loaded charges. In another aspect, this can involve improving the bulk strength of explosive charges by increasing the density of energetic material in the charges, thus increasing the explosive energy per foot of borehole without incurring additional drilling costs.

Herein the term "energetic material" refers to a material that is capable of being rendered detonable and that has stored chemical energy that can be released when the material is detonated. The energetic materials described herein can be in fluid or liquid form, and here specific mention may be made of explosive emulsions, water gels, slurry explosives, and blends thereof (e.g., blends of emulsions, water gels, or slurry explosives with ammonium nitrate (AN) or ammonium nitrate-fuel oil (ANFO)). Such emulsions, water gels, slurry explosives, and blends thereof are well known in the art in terms of components used and formulation. In some embodiments, the energetic materials described herein may include dry solid materials, typically in granular form, such as ANFO (which can encompass AN prill having between 0% and 10% fuel oil, such as between about 0.1% to about 10%, or about 0.5% to about 6% fuel oil). An "explosive charge" as discussed herein is a construct comprising detonable energetic material, where "detonable" refers to the capability to be triggered to detonate by conventional initiation means.

Previous approaches to enhancing the characteristics of bulk energetic materials have included combining these materials with ammonium nitrate (AN) prill. Such "blended" explosives can provide enhanced blast energy in some applications. However, the use of such blends can also present difficulties, including increased cost of manufacture, variable detonation performance, increased production of noxious fumes, decreased stability and decreased pumpability.

The present disclosure discusses alternative approaches to enhancing blasting performance in explosive charges. In one aspect, these approaches can involve increasing the weight of powder in each borehole through increasing overall average density of straight fluid or liquid energetic material, resulting in pattern expansion. Potential benefits include having fewer holes needed for a given operation due to increased impulse per charge and/or improved powder factor.

Systems for delivering explosives and methods related thereto are disclosed herein. It will be readily understood that the components of the embodiments as generally described below and illustrated in the Figures herein could be arranged and designed in a wide variety of different configurations. Thus, the following more detailed description of various embodiments, as described below and represented in the Figures, is not intended to limit the scope of the disclosure, but is merely representative of various embodiments. While the various aspects of the embodiments are presented in drawings, the drawings are not necessarily drawn to scale unless specifically indicated.

Reference throughout this specification to "an embodiment" or "the embodiment" means that a particular feature, structure, or characteristic described in connection with that embodiment is included in at least one embodiment. Thus, the quoted phrases, or variations thereof, as recited throughout this specification are not necessarily all referring to the same embodiment.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

The phrases "operably connected to," "connected to," and "coupled to" refer to any form of interaction between two or more entities, including mechanical, electrical, magnetic, electromagnetic, fluid, and thermal interaction. Likewise, "fluidically connected to" refers to any form of fluidic interaction between two or more entities. Two entities may interact with each other even though they are not in direct contact with each other. For example, two entities may interact with each other through an intermediate entity.

In an aspect of the present disclosure, methods of increasing explosive density of an explosive charge delivered into a bore hole can involve loading the hole with a detonable charge in which energetic material is arranged in concentric zones of differing densities. More particularly, a charge may have a generally columnar (e.g., cylindrical) shape and may include a core of energetic material having a particular density at least partially surrounded by an annular zone of energetic material having a different density. The annular zone may have a substantially uniform thickness, or may vary in thickness around the core and/or along the length of the charge. In some embodiments, the annular zone substantially completely surrounds the core. In some embodiments, the annular zone extends around at least 50% of the perimeter of the core, for example around about 50% to about 100%, or about 50% to about 65%, or about 65% to about 100% of the perimeter of the core. Stated somewhat differently, the annular zone surrounds the core to a degree such that the annular zone contacts at least 50%, or about 50% to about 100%, or about 50% to about 65%, or about 65% to about 100% of the inner perimeter of the bore hole.

Figure 1B:
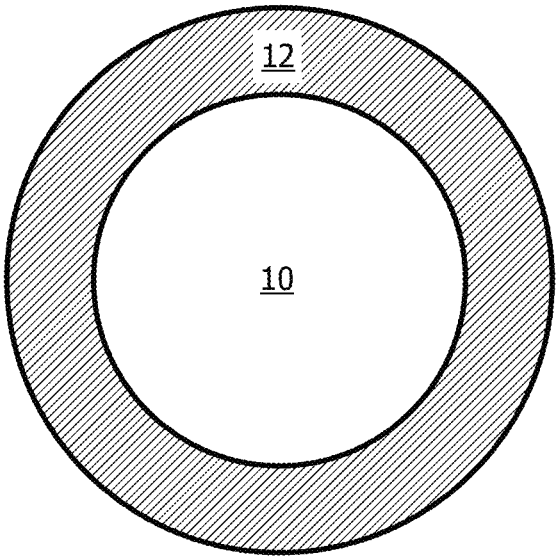
FIG. 1B is a cross-section diagram illustrating the geometry of an explosive charge in accordance with another embodiment.

It is generally accepted that fluid or liquid energetic materials are rendered detonable (i.e., "sensitized") by reducing the density of the material. This is typically accomplished by introducing voids—e.g., gas bubbles, inert microspheres—into the material matrix. Therefore, detonability in such materials may be generally considered to be related to lower density. However, the present disclosure describes an approach to enhancing the blast energy of an explosive charge that involves increasing the overall density of the explosive charge while preserving detonability. So for example, such an explosive charge can include an amount of less dense (e.g., sensitized) material geometrically arranged with an amount of denser (e.g., unsensitized) material. As stated above, in some embodiments these differentiated energetic materials may be provided in a core/annulus arrangement. FIG. 1A and FIG. 1B show cross-section diagrams of two exemplary explosive charge configurations. FIG. 1A illustrates an explosive charge geometry comprising a core 10 of energetic material having a lower density (indicated by the hatched pattern) surrounded by an annulus 12 of material having a higher density. FIG. 1B shows a geometry in which the relative placement of the differentiated energetic materials is reversed, i.e., the material in the core 10 has a higher density than the material in the annulus 12.

It should be noted that the present disclosure encompasses both explosive charge structures in which the less dense energetic material in the charge is sensitized and the denser energetic material is unsensitized, as well as structures in which both energetic materials are sensitized, but to differing degrees. It should also be noted that the present disclosure encompasses explosive charges in which the difference in sensitization between the energetic materials is at least partially generated by differential addition of a sensitizing material that may not necessarily decrease the density of the energetic material to which it is added. Examples of such sensitizing materials include prilled ammonium nitrate (AN)

and porous AN prill with 0% to about 10% (such as about 0.5% to about 6%) fuel oil (ANFO).

In various embodiments, an explosive charge structure as described herein can include at least one zone of sensitized, i.e., detonable, energetic material. The explosive charge may further include a zone of higher density energetic material that, standing alone, may be less detonable than the first material, or that may be substantially insensitive to conventional initiation methods. An effect of the inclusion of higher density energetic material is an increase in the overall density of the explosive charge as compared to a charge of equal volume comprising the (more) sensitized material alone. It is a generally accepted principle that increasing the density of energetic material in a charge can negatively affect detonability and therefore the effectiveness of the resulting explosion. However, a surprising result of the charge structures described herein is increased explosive density with maintained or enhanced explosive characteristics.

In accordance with the present disclosure, methods of increasing the density of an explosive charge loaded into a bore hole can comprise establishing two independent parallel streams of energetic material flowing from a source of said material to a bore hole, so as to form in the bore hole an explosive charge comprising material from both streams. The energetic material in the two streams can be made to differ in their respective densities. Accordingly, the method may comprise creating this difference between the streams by adding a density reducing agent to the energetic material in at least one of the streams to produce a stream of lower density material as compared to the other stream. For example, upon establishing two streams from a source of unsensitized energetic material, a density reducing agent may be added to one of the streams, thereby resulting in a stream of sensitized material, while the other parallel stream remains unsensitized.

The density reducing agent may be any agent effective for producing sensitizing voids within the energetic material. In some embodiments, the voids may be gas bubbles. Accordingly, the density reducing agent may be a compressed gas introduced into the stream mechanically, e.g., by aeration. Alternatively, the density reducing agent may be a chemical gassing solution that, when added to the stream, reacts with the energetic material to generate gas bubbles. In some embodiments, the density reducing agent comprises solid bodies that can be dispersed within the energetic material to form voids. Such density reducing agents include hollow or solid microspheres which may be formed from glass, plastic or another suitable material. Hollow or solid microspheres may also be referred to as microballoons or beads. As discussed above, differentiation of the streams based upon degree of sensitization may also be achieved by other sensitizing materials, such as AN prill and ANFO. Accordingly, the term "density reducing agent" as used herein may also encompass such sensitizing materials, regardless of whether addition of the sensitizing material has the effect of reducing the density of the energetic material to which it is added.

The respective paths of the two streams can be spatially arranged so that material from one stream forms the core of the explosive charge, while material from the other stream forms the annular zone. In some embodiments, the streams are caused to flow in a coaxial configuration at some point prior to formation of the explosive charge e.g., in the bore hole. Stated differently, the streams may be directed into respective flow paths comprising a core flow path aligned coaxially with respect to an annular flow path. As discussed above, in some embodiments, the lower density stream may be directed to the core flow path so as to produce an explosive charge in which the material in the core is lower density/more sensitized than that in the annulus. This arrangement, in which less sensitized or unsensitized material is in contact with the inner surface of the bore hole, may confer additional benefits such as increased water resistance or decreased sensitivity to reactive ground.

The overall average density of the explosive charge will depend on the respective densities and the respective volumes of energetic material provided by the two streams. Therefore, either or both of these parameters may be selected and adjusted to produce an explosive charge having a desired average density. In some embodiments, one or both of flow rate and component density are selected or adjusted to produce an explosive charge having an overall average density of about 0.5 g/cc to about 1.6 g/cc. In some embodiments, the flow rate of one or both streams of energetic material may be selected or adjusted to produce a selected volume ratio between lower density and higher density materials in the explosive charge. In some embodiments, the volume ratio of lower density energetic material to higher density energetic material in the explosive charge is about 10% to about 85%. In some embodiments, a detonable explosive charge formed by the methods described herein can have a mass that is greater than that of a charge comprising an equivalent volume of the lower density energetic material. The percent increase in mass depends on the relative densities of the two streams.

The ranges of densities of the energetic material in each stream will depend at least in part on the type of energetic material used. That is, the density of the material in its unsensitized state establishes an upper boundary of the available densities that may be employed. For example, an unsensitized water-in-oil emulsion may have a typical density ranging from about 1.34 g/cc to about 1.45 g/cc. In some embodiments, one of the streams comprises an unsensitized emulsion having a density of about 1.35 g/cc to about 1.40 g/cc and the other stream comprises a sensitized emulsion having a density of about 1.15 g/cc to about 1.25 g/cc. In some embodiments, the two streams comprise emulsions having different densities, where both densities are less than about 1.35 g/cc. In some embodiments, the two streams comprise energetic materials wherein the energetic material in one stream has a density sufficient to render the explosive charge detonable. In some embodiments, one stream has a density that is about 0.05 g/cc to about 0.50 g/cc less than the energetic material in the other stream.

One or both of the streams of energetic material may be subjected to other processing steps before being deposited into the bore hole. For example, the energetic material in one or both streams may be subjected to thickening, for example, by subjecting the material to shear stress. Thickening of emulsion energetic materials has been observed to increase explosive performance. Without wishing to be bound to any particular theory, the process of thickening can disrupt relatively large droplets of oxidizer salt solution, thereby converting such emulsion droplets into smaller droplets that have a narrower size distribution. In some embodiments, only the energetic material in the annular stream is thickened.

The methods described herein may be used to charge bore holes having a range of diameters. In some embodiments, the bore hole diameter can be from about 4 inches (10.15 centimeters) to about 20 inches (50.8 centimeters), or more particularly, from about 4 inches to about 10 inches, from about 10 inches to about 15 inches, or about 15 inches to about 20 inches. In a particular embodiment, the bore hole is about 12 inches in diameter. In another particular embodiment, the bore hole is about 16 inches in diameter. In some embodiments, bore holes having diameters from about 2 inches to about 20 inches, or from about 2 inches to about 10 inches, may be loaded with packaged charges made in accordance with the present disclosure.

In some embodiments, an explosive charge may comprise a core of energetic material having one density surrounded by an annulus of energetic material having a different density, where said core and annulus are separated by a layer of material. For example, the core can comprise energetic material situated within a cylindrical or tubular liner inserted into a bore hole, said liner having a diameter smaller than that of the bore hole, while the annulus comprises energetic material delivered into the bore hole outside the liner. This approach can facilitate preservation of the relative geometric arrangement of the two energetic materials, for example, when one is a dry solid material and the other is a liquid material.

While the approaches discussed in the present disclosure are primarily described in the context of forming explosive charges within bore holes, these approaches are also applicable to the making of packaged explosive charges. That is, in some embodiments, an explosive charge may comprise a core of energetic material having one density surrounded by an annulus of energetic material having a different density, where said core and annulus are sealed in a container. The container may comprise a flexible packaging material formed into a tube or a bag. Materials suited for this purpose include, but are not limited to, plastics such as polypropylene, polyethylene, polyvinyl chloride, polyvinylidene chloride, nylon, polyacrylonitrile, polyethylene terephthalate, polybutadiene, polycaprolactam, polyurethanes, natural and synthetic rubbers, polyepoxide resins and the like, as well as kraft paper and fabrics made of cotton, burlap, jute, sisal, or hemp. In some embodiments, the packaged charge may be equipped with a detonator and/or a length of detonating cord.

The present disclosure also encompasses various systems configured for loading explosive charges into bore holes as described above. As described herein, systems for loading a geometric configuration of energetic material into a bore hole can comprise: a source for supplying an energetic material; and a conduit fluidically connected to the source and providing flow paths for at least two independent parallel streams of energetic material from the source to a bore hole. Such systems may further comprise means for varying a flow rate of energetic material in at least one of the flow paths. Systems may further comprise a subsystem for supplying a density reducing agent and introducing said agent into at least one of the flow paths.

As discussed above, one aspect of the systems and methods described herein is the provision of parallel independent streams of energetic material, where the material streams differ in one or more characteristics, particularly density. Another aspect is the delivery of the differentiated streams into a bore hole so as to create an explosive charge therein having a particular geometric arrangement of material from the respective streams. FIG. 2-FIG. 5C show process flow diagrams illustrating systems in accordance with the present disclosure. Optional streams/connections are indicated by dashed arrows. It should be understood that these are process flow diagrams and are not intended to dictate physical locations of any of the illustrated components, nor are they intended to limit the number or types of components that may be included.

Figure 2:
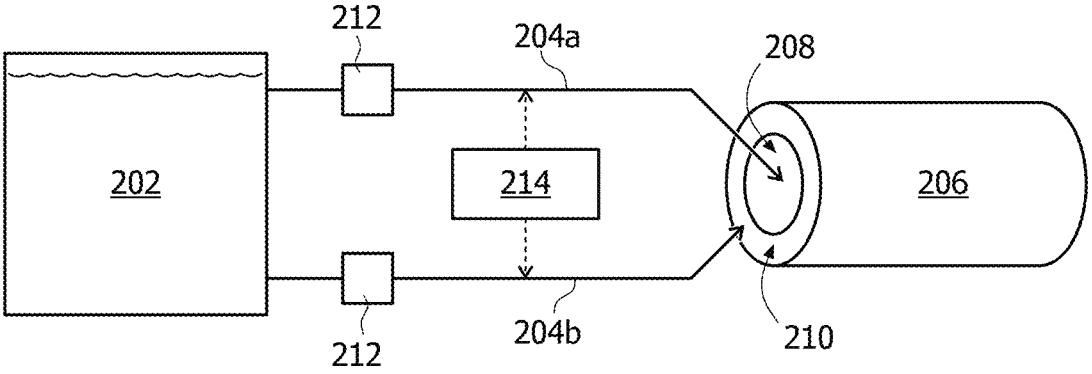
FIG. 2 is a process flow diagram illustrating relationships among selected components of a system in accordance with one embodiment.

Referring to FIG. 2, a system can comprise a source 202 for supplying an energetic material flowing in two parallel independent streams 204*a* and 204*b*. The source 202 can be a reservoir, tank, hopper, bin or other structure suitable for containing the energetic material. The system can further comprise a conduit 206 fluidically connected to the source 202 and configured for conveying the streams 204*a* and 204*b* into a bore hole and depositing energetic material therein in a particular geometric arrangement. For example, as shown in FIG. 2, the conduit 206 can be configured to provide two coaxial flow paths, i.e. a core flow path 208 situated within an annular flow path 210. As illustrated, the core flow path 208 is sufficiently smaller in diameter than the annular flow path 210 so as to allow the stream 204*b* to surround the core flow path 208 while flowing freely down the annular flow path 210. In some embodiments, such a conduit 206 may be a loading hose comprising an outer tube and inner tube that are sized and arranged to provide flow paths having the foregoing characteristics.

In some embodiments, the conduit 206 may be directly connected to the source 202, and thereby provide the only flow paths from the source 202 for the streams 204*a* and 204*b*. In some embodiments, the system may include intervening delivery lines through which the streams flow from the source 202 yet before entering the conduit 206. The conduit 206 can have a diameter and length allowing it to be inserted into a bore hole and to eject the streams of energetic material at a desired location within the bore hole. Such configuration may include an end structure such as a nozzle adapted for ejecting the energetic material while preserving the geometric configuration of the respective streams. In some embodiments, the conduit may further comprise additional flow paths for conveying additives and configured for introducing them into one or both of the streams.

The system can further comprise components or subsystems for differentiating the streams 204*a* and 204*b* with respect to a property, particularly density. As shown in FIG. 2, a sensitizing subsystem 214 can be configured for supplying a density reducing agent and optionally introducing said agent into one or both of stream 204*a* and stream 204*b*. For example, the sensitizing subsystem 214 can be fluidically connected to a flow path of one or both streams so as to introduce the density reducing agent into the stream(s) at some point before the energetic material is deposited in the bore hole. In some embodiments, the sensitizing subsystem 214 is configured to introduce a density reducing agent into only one of stream 204*a* or stream 204*b* while the other stream remains unsensitized. In some embodiments, the sensitizing subsystem 214 is configured to introduce a density reducing agent into either or both of streams 204*a* and 204*b*. The sensitizing subsystem 214 may be further configured to deliver density reducing agent into the streams at different rates and thereby produce two streams that are sensitized to differing degrees. It should be noted that the position of the sensitizing subsystem 214 in the diagram is not intended to specify or otherwise limit the location at which it is connected to either stream. For example, in the configuration shown, the sensitizing subsystem 214 may introduce density reducing agent into either stream at any point between the source 202 and the opposite end of the conduit 206. In some embodiments, a sensitizing subsystem may introduce density reducing agent into one of the streams at a point near the distal end of the conduit.

As discussed above, the average density of an explosive charge can be determined in part by the relative volumes of energetic material from the two streams. To provide for the selection of average charge density, the system can further comprise at least one flow rate control mechanism 212 configured for varying the flow rate of energetic material in at least one of the streams. As discussed in further detail below, the flow rate control mechanism 212 may be adapted to regulate the flow of energetic material in the stream to which it is operably connected with sufficient specificity to allow selection of a ratio between the flow rates of the two streams. In some embodiments, a flow rate control mechanism 212 may be operably connected to one of the streams of energetic material to allow control of the flow rate in that stream, while the other stream's flow rate is primarily determined by pressures in the system. In some embodiments, as illustrated in FIG. 2, a flow rate control mechanism is operably connected to each of the streams, allowing for independent selection and adjustment of the flow rate of each stream of material.

Figure 3:
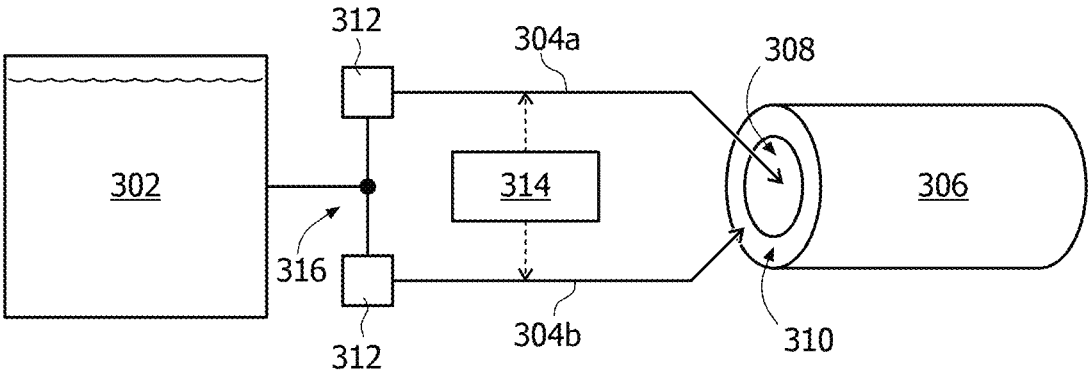
FIG. 3 is a process flow diagram illustrating relationships among selected components of a system in accordance with another embodiment.

Different system configurations can be utilized to provide for the establishment of parallel streams of energetic material. As illustrated in FIG. 2, these streams can be supplied by a single source of energetic material having two outlets, each of which gives rise to a stream 204*a* or stream 204*b*. In some embodiments, as illustrated in FIG. 3, energetic material may issue from a source 302 by one outlet and enter a flow splitter 316 that generates two streams 304*a* and 304*b*. Each of the streams is directed to one of the core flow path 308 and annular flow path 310 provided by conduit 306. Differentiation of the streams may be accomplished through operable connections with flow rate control mechanisms 312 and a sensitizing subsystem 314. The sensitizing subsystem 314 may introduce density reducing agent into either stream at any point between the flow rate control mechanism 312 and the distal end of the conduit 306.

In certain embodiments (not shown), a system may be configured so that energetic material may issue from a source by one outlet and then enter a conduit having a flow splitter situated at some downstream point, e.g., at or near the distal end of the conduit (e.g., such as in a nozzle). A sensitizing subsystem may be operably connected to the conduit downstream of the flow splitter (e.g., at a more distal end of a nozzle), so that a density reducing agent may be introduced into one or both streams of energetic material before the streams exit the distal end of the conduit.

Figure 4:
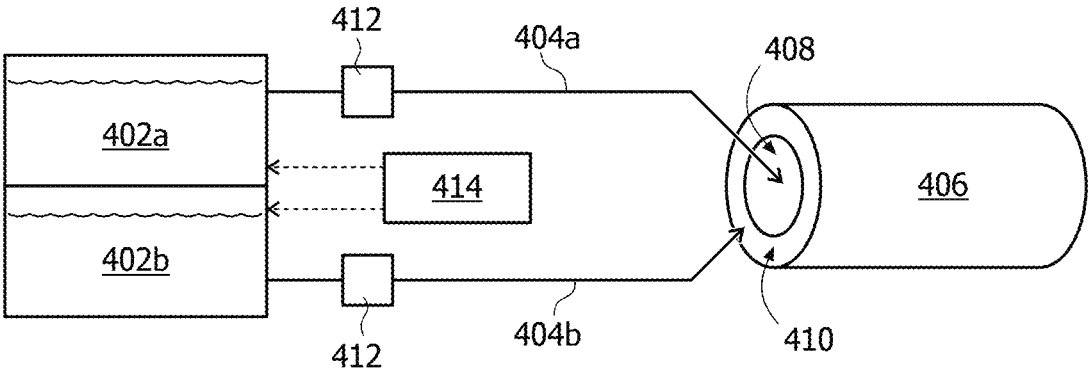
FIG. 4 is a process flow diagram illustrating relationships among selected components of a system in accordance with another embodiment.

Still other embodiments may be configured as illustrated by the process flow diagram shown in FIG. 4. In this configuration, each of streams 404*a* and 404*b* is independently supplied by source 402*a* and source 402*b*, respectively. The two sources 402*a* and 402*b* may hold energetic material that is already differentiated, for example, the energetic material in source 402*a* may have a different density from that in source 402*b*. In some embodiments, this differentiation may be accomplished through a sensitizing subsystem 414 operably connected to one or both sources.

In some embodiments, a flow rate control mechanism can comprise one or more valves that can be actuated to restrict fluid flow to some degree, i.e., throttling valves. Such valves particularly include those that provide a variable and controllable degree of restriction. In various embodiments, the valve may provide degrees of flow restriction ranging from substantially no restriction of flow to substantially complete stoppage of flow. In some cases, full stoppage may be achieved by using a plurality of valves in series. Such valves include, but are not limited to, pinch valves, diverter valves, diaphragm valves, butterfly valves, and globe valves. The flow rate control mechanism may be configured for manual or electronic control and actuation of the component valve (s).

Figure 5A:
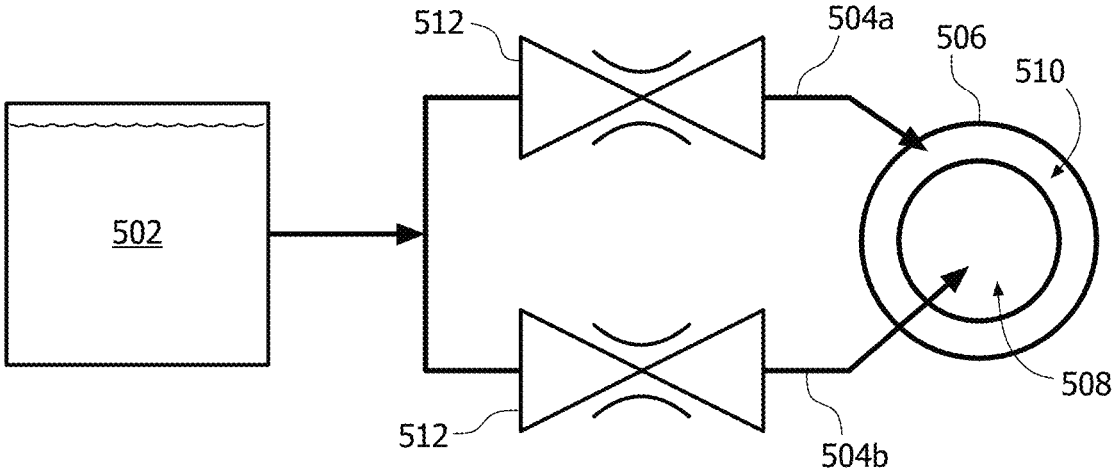
FIG. 5A is a process flow diagram illustrating a configuration of selected components of a system in accordance with an embodiment.
Figure 5B:
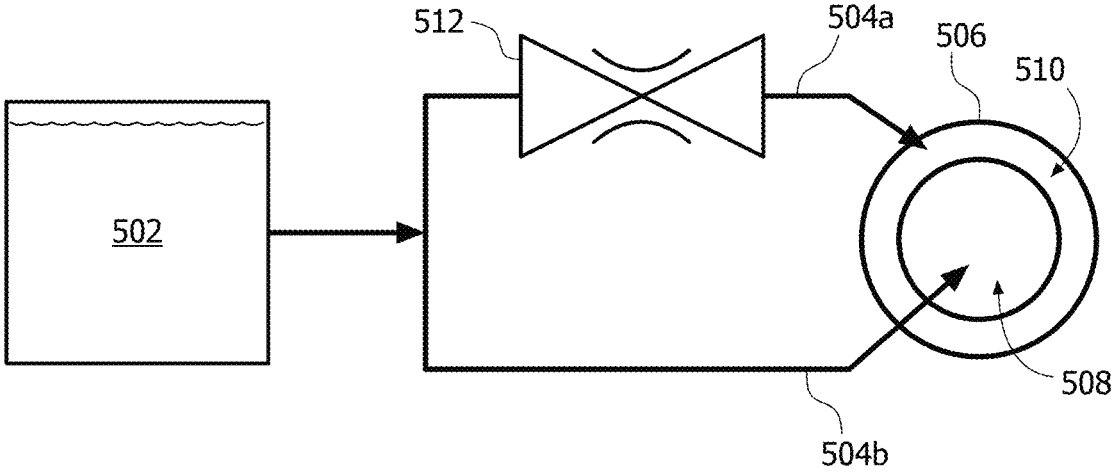
FIG. 5B is a process flow diagram illustrating a configuration of selected components in accordance with another embodiment.
Figure 5C:
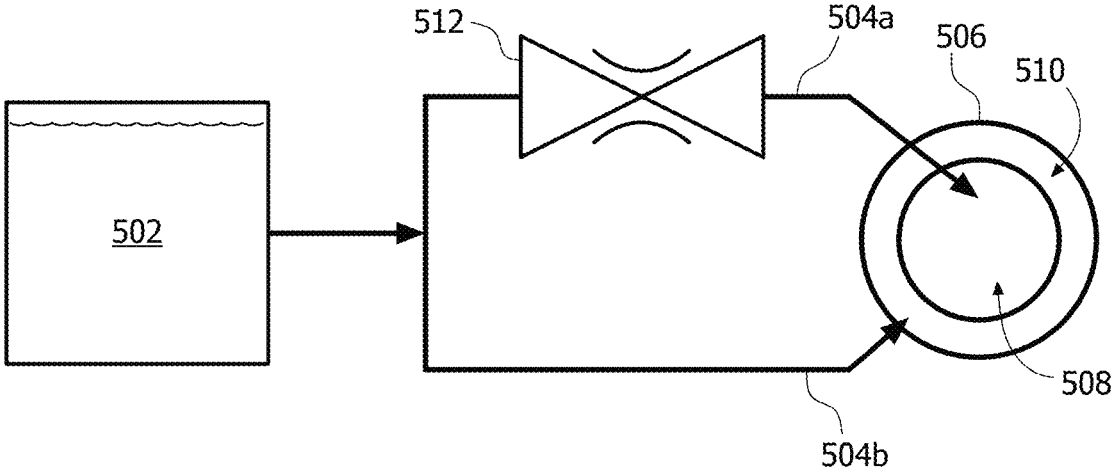
FIG. 5C is a process flow diagram illustrating a configuration of selected components in accordance with still another embodiment.

Systems according to the present disclosure may employ various arrangements of restriction-based flow rate control mechanisms, as illustrated in the process flow diagrams shown in FIG. 5A through FIG. 5C. For example, as shown in FIG. 5A, the flow rate in each of parallel streams 504*a* and 504*b* (which, in the example shown, originate from a single outlet of source 502) may be selected/adjusted by a valve 512. This arrangement allows for direct control of the amount of energetic material directed to each of the core flow path 508 and the annular flow path 510. In some embodiments, as shown in FIG. 5B and FIG. 5C, the flow rate of only one stream is controlled by a valve 512. This arrangement provides for control of average charge density by controlling the amount of energetic material flowing in the annular flow path 510 (FIG. 5B) or the core flow path 508 (FIG. 5C).

Figure 6:
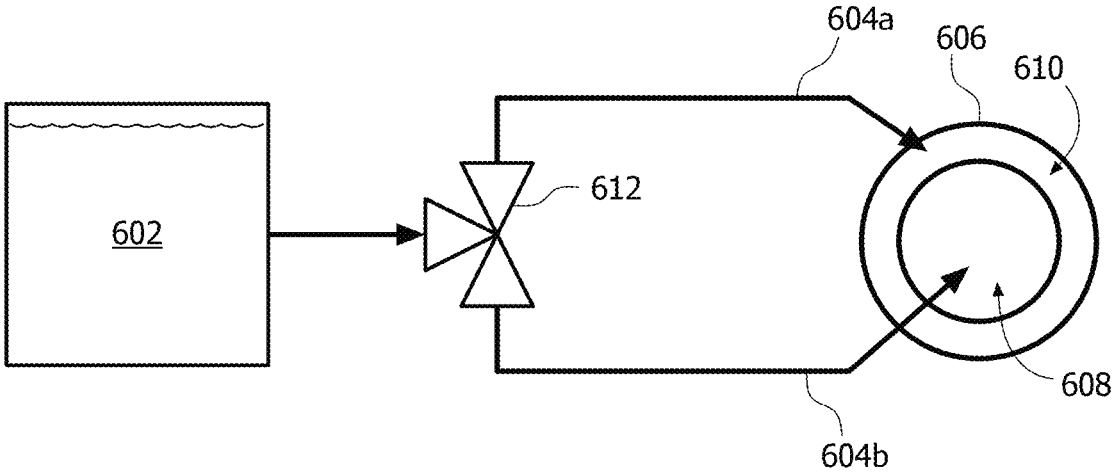
FIG. 6 is a process flow diagram illustrating a configuration of selected components of a system in accordance with an embodiment.

FIG. 6 illustrates a different arrangement in which energetic material from a source 602 is directed to a diverging valve 612 that splits the flow of material proportionally between two streams 604*a* and 604*b*. The respective flow rates of the resultant streams are determined by the output ratio of the diverging valve 612. In some embodiments, the diverging valve 612 provides a plurality of output ratios, for example a number of discrete output ratios, or alternatively a continuous range of ratios. In some embodiments, the output ratios can be adjusted as desired.

Figure 7:
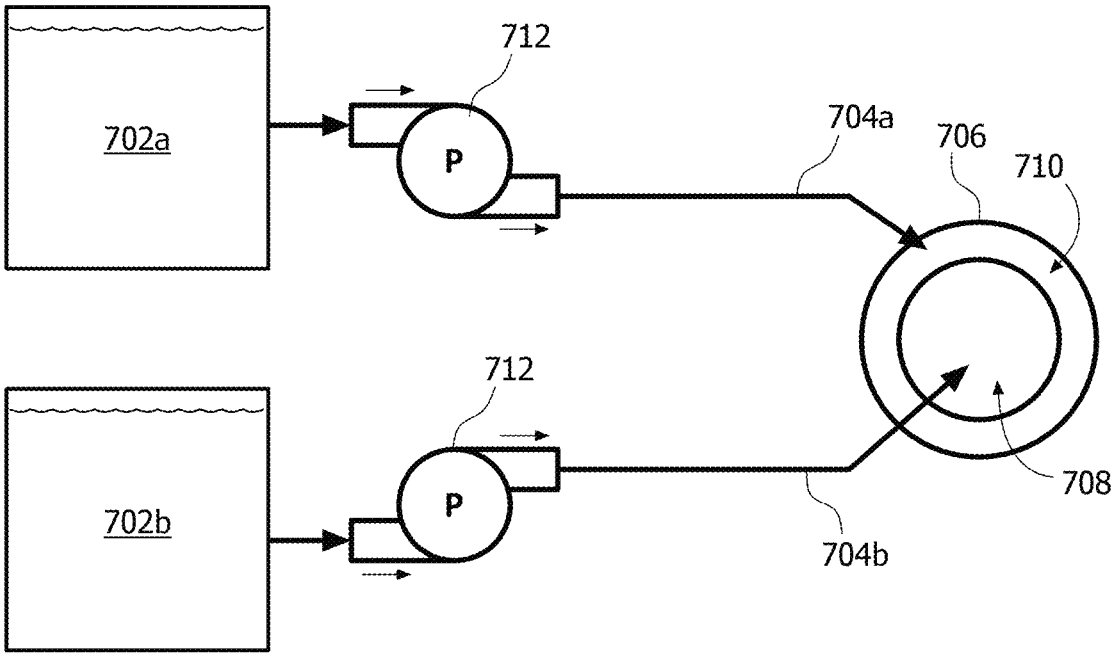
FIG. 7 is a process flow diagram illustrating a configuration of selected components of a system in accordance with another embodiment.

In some embodiments, the flow rate control mechanism can comprise one or more pumps operably connected to one or both streams of energetic material. More particularly, the flow rate control mechanism may comprise variable speed pumps for directly controlling stream flow rate. One such configuration is illustrated in FIG. 7, in which streams 704*a* and 704*b* arise from source 702*a* and source 702*b*, respectively, and are directed to a corresponding flow path (708 or 710) of conduit 706. Each stream is impelled down its path by an inline pump 712, the pumping speed of which determines the flow rate of that stream.

Systems may include further components configured for treating or processing one or both of the streams of energetic material before delivery into the bore hole. Such components include homogenizers. Other components include systems for introducing additives that are appropriate for the particular energetic material, such as inhibitors, lubricants, cross-linkers, bulking agents and thickeners. In some embodiments, some or all of the components described herein can be part of a mobile processing or manufacturing unit.

The systems and methods disclosed herein may be used for delivering explosives with variable densities based upon geological properties in a blast site. For example, target explosive properties (e.g., explosive energy) for each hole in a blast pattern may be determined by identifying change points in geological properties (e.g., hardness values) within a blast hole and/or across a blast site. More specifically, target explosive densities may be determined for discrete sections of individual blast holes and/or groups of blast holes across a blast pattern, based upon representative hardness values for each section/group. In the systems and methods described herein, flow rate control mechanisms (e.g., valves) may be used to vary average density within an explosive charge as it is loaded into a bore hole, so as to provide a target explosive density profile identified for that bore hole or section thereof (e.g., such as a discrete section having particular hardness values). Similarly, this approach can be repeated for groups of bore holes across a blast pattern to provide a target density profile identified for the blast pattern.

Example 1—Average Densities Corresponding to Concentric Geometries

Figure 8:
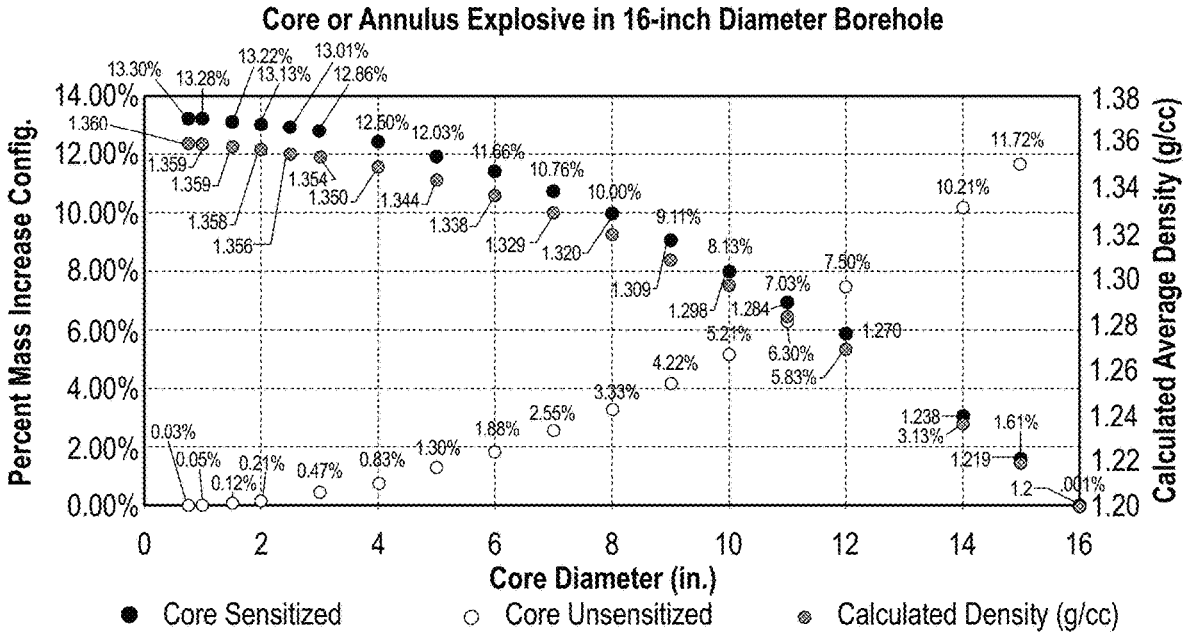
FIG. 8 shows a graph relating average density to geometries of explosive charges for 16-inch diameter bore holes in accordance with the present disclosure.
Figure 9:
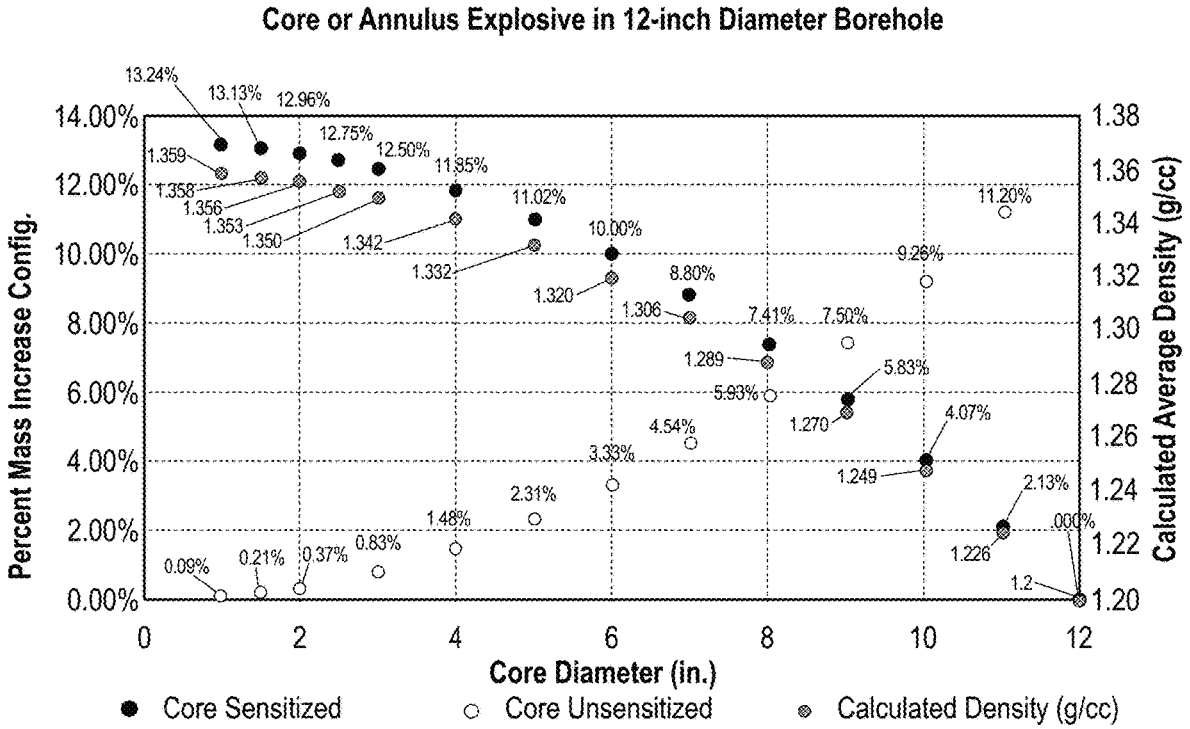
FIG. 9 shows a graph relating average density to geometries of explosive charges for 12-inch diameter bore holes in accordance with the present disclosure.
Figure 10:
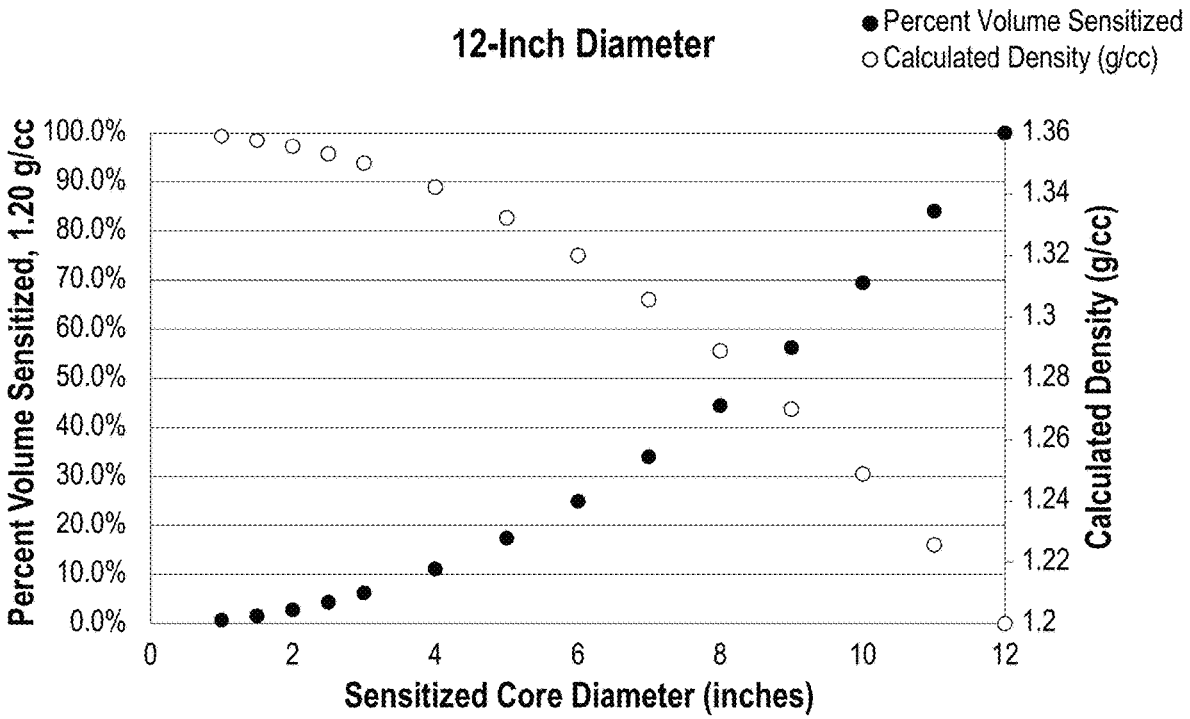
FIG. 10 shows a graph relating calculated average density to percent sensitized volume of explosive charges for 12-inch diameter bore holes in accordance with the present disclosure.
Figure 11:
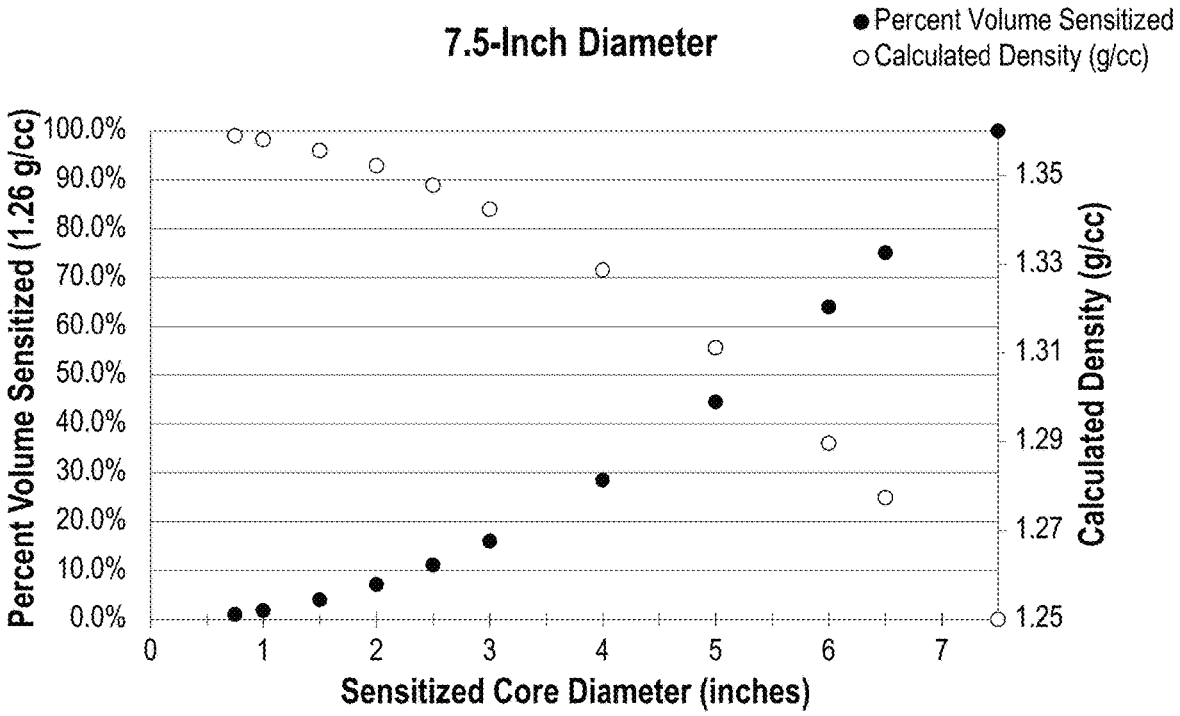
FIG. 11 shows a graph relating calculated average density to percent sensitized volume of explosive charges for 7.5-inch diameter bore holes in accordance with the present disclosure.
Figure 12A:
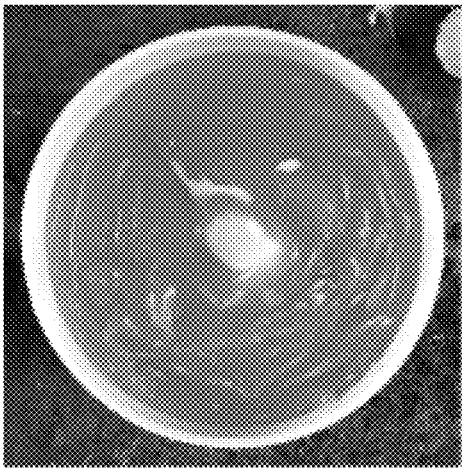
FIGS. 12A through 12E show 12-inch diameter explosive charges having various diameters of sensitized emulsion (density=1.20 g/cc) surrounded by an annulus of unsensitized emulsion (density=1.36 g/cc). Core diameters are 1.5, 2.5, 6, 8 and 10 inches as shown in FIG. 12A through FIG. 12E, respectively.
Figure 12B:
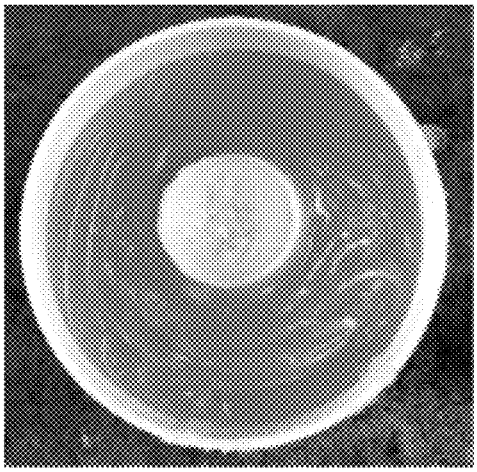
Figure 12C:
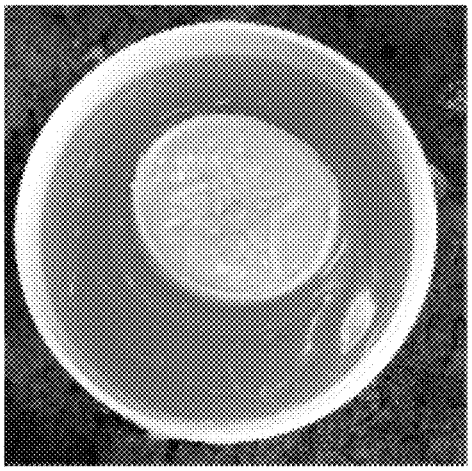
Figure 12D:
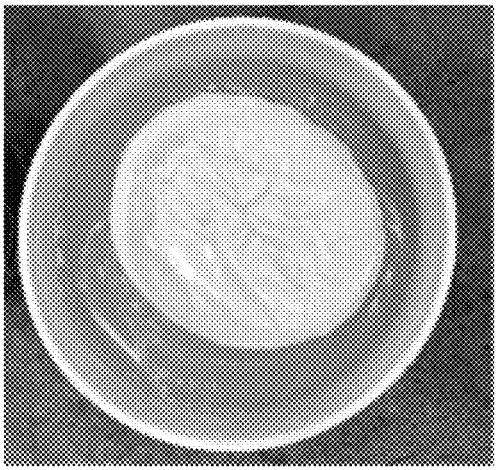
Figure 12E:
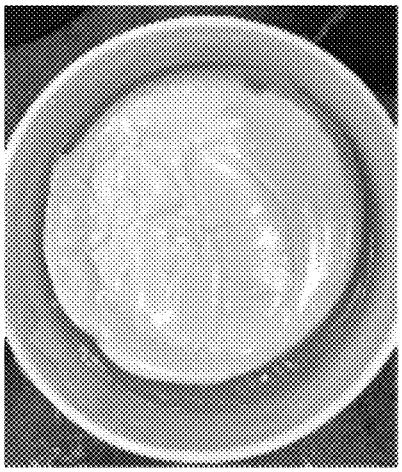

The relationship between core diameter and average density was modeled for explosive charges having a concentric geometry according to the present disclosure. This was done for charges in which either the core or the annular zone comprised a sensitized emulsion (density=1.20 g/cc) and the other zone comprised an unsensitized emulsion (density=1.36 g/cc). FIG. 8 shows the results based on loading into a 16-inch diameter bore hole, and FIG. 9 and FIG. 10 show results based on loading into a 12-inch diameter bore hole. Results show that powder factor can be increased by varying the amount of sensitized and unsensitized material in each zone, where the percentage increase in charge mass increases as the difference between high density and low density materials increases. Results for the 16-inch hole show that charge mass can be increased by up to 13.33%. Results for the 12-inch hole show an increase of up to 8.8%. A similar relationship is shown in FIG. 11 based on loading into a 7.5-inch diameter bore hole.

Example 2—Charge Creation and Testing

Charges were created by filling 3.5-gallon buckets (ca. 12-inch diameter) with various diameters of sensitized emulsion (density=1.20 g/cc) surrounded by an annulus of unsensitized emulsion (density=1.36 g/cc). Tested core diameters included 1.5, 2.5, 6, 8 and 10 inches as shown in FIG. 12A through FIG. 12E, respectively. Additional core diameters of 1 and 4 inches were tested as well though not shown. The explosive charges were detonated underwater at the same depth and location in a pond. Most charges were characterized in duplicate and were compared to controls in which the bucket was filled with 1.20 g/cc emulsion only. An Instantel Minimate Blaster seismometer placed in the earth close to the pond was used to characterize the total explosive impulse, peak explosive impulse, and acceleration from explosion. Each of the discussed values were normalized to the weight of explosive in each bucket.

Example 3—Characterization—Average Peak Vector Sum

Figure 13A:
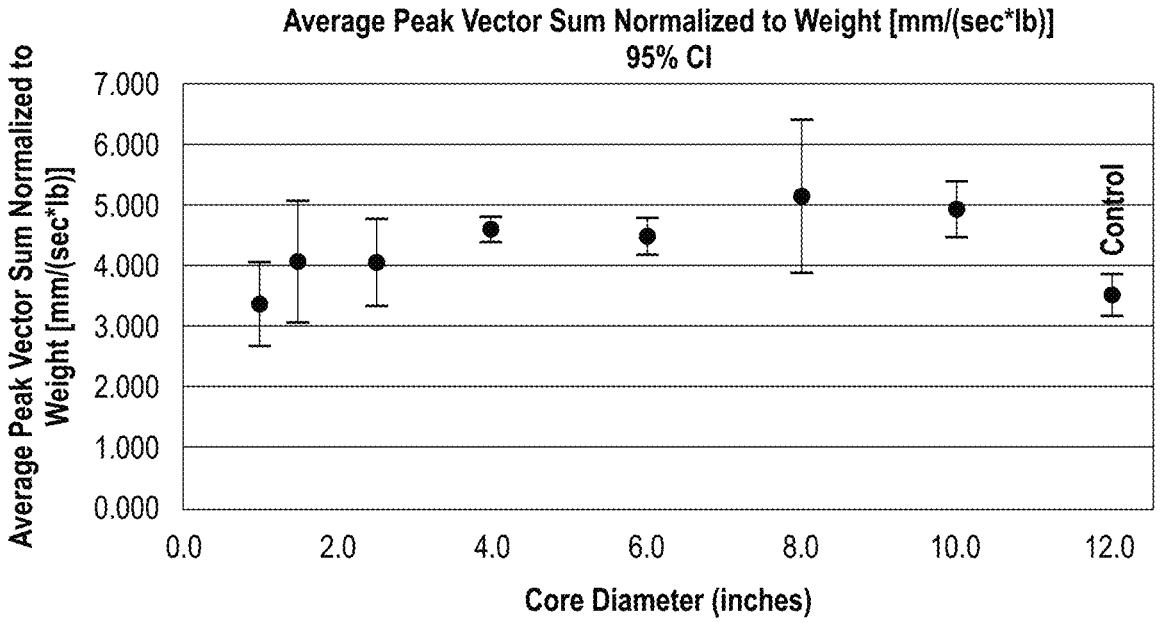
FIG. 13A is a graph of average peak vector sum of each of the charges shown in FIG. 12A through FIG. 12E, normalized to the charge's weight and plotted against core diameter.
Figure 13B:
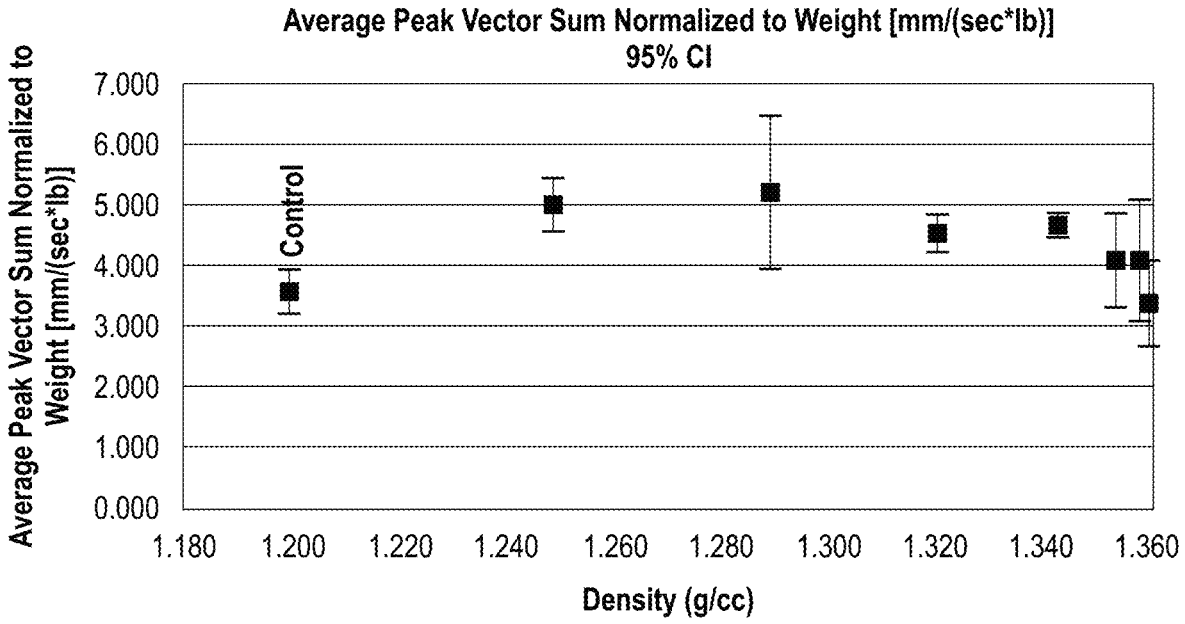
FIG. 13B is a graph of average peak vector sum of each of the charges shown in FIG. 12A through FIG. 12E, normalized to the charge's weight and plotted against charge average density.

Average peak vector sum is a metric that demonstrates the average maximum impulse from a given shockwave as follows: $\sqrt{T^2+V^2+L^2}$, where T=particle velocity along the transverse plane, V=particle velocity along the vertical plane, and L=particle velocity along the longitudinal plane. Average peak vector sum was calculated for each of the charges created in Example 2 and plotted against core diameter (FIG. 13A) and average density of the charge (FIG. 13B). As shown, the average peak vector sum is larger than the control for core-explosive diameters between 4-10 inches. At diameters lower than 4 inches and down to 1.5 inches, there appears to be some benefit, though the error bars overlap with the control. This data indicates a technological improvement when compared to the control. It further indicates the powder factor can be increased without negatively affecting the impulse from the delivered explosive. This can translate into reducing the number of holes drilled.

Example 4—Characterization—Average Peak Acceleration

Figure 14A:
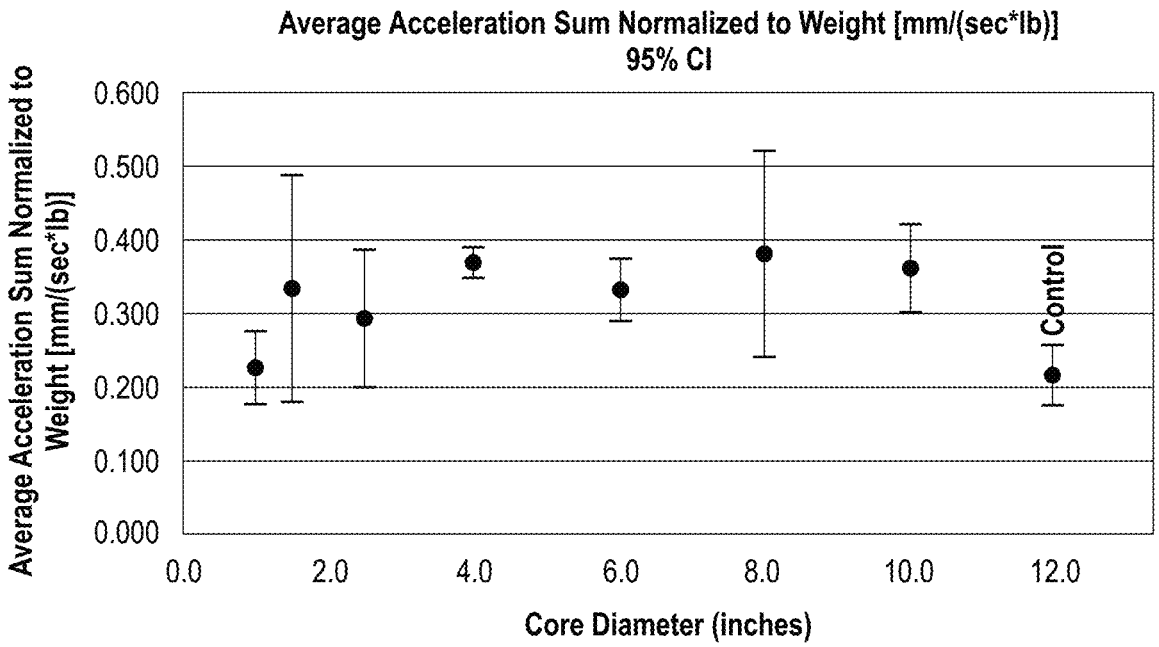
FIG. 14A is a graph of average acceleration sum of each of the charges shown in FIG. 12A through FIG. 12E, normalized to the charge's weight and plotted against core diameter.
Figure 14B:
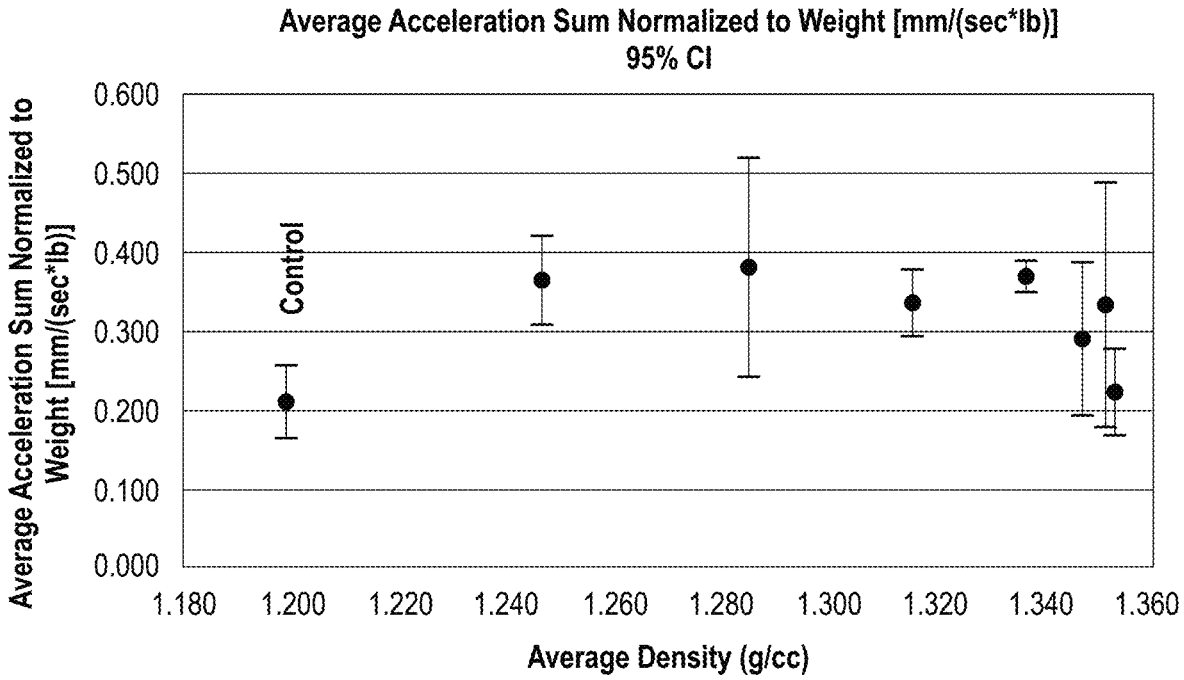
FIG. 14B is a graph of average acceleration sum of each of the charges shown in FIG. 12A through FIG. 12E, normalized to the charge's weight and plotted against charge average density.

Peak acceleration is the rate of change of a shockwave's velocity. This can be viewed as the rate of impulse from the explosive shockwave. The average acceleration sum was calculated for each of the charges created in Example 2 and plotted against core diameter (FIG. 14A) and average density of the charge (FIG. 14B). The results show that the acceleration in the shockwave is greater than the control for core-explosive diameters between 4-10 inches. At diameters lower than 4 inches and down to 1.5 inches, there appears to be some benefit, though the error bars overlap with the control. The average data further suggests the acceleration is greater than the control. This indicates potential improvement in rock breakage and fragmentation when compared to the 1.20 g/cc control.

Example 5—Characterization—Post-Blast Fume Reduction

Figure 15:
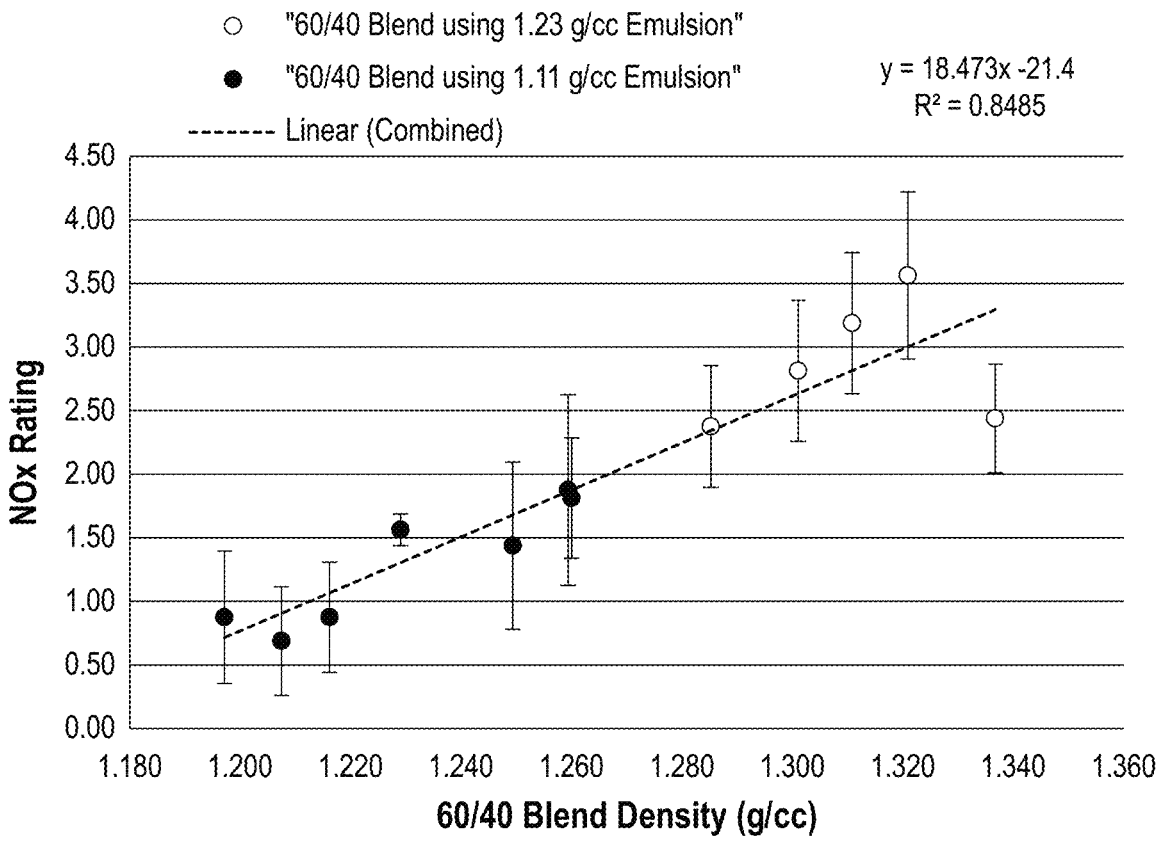
FIG. 15 is a graph of the nitrogen oxides (NOx) rating plotted against charge average density for geometric charges according to the present disclosure and compared to a blend comprising 60% 1.25 g/cc emulsion and 40% ANFO.

During testing, a reduction in post-blast fumes (NOx) was noticed when testing high-average density products similar to 60/40 blends (60% 1.25 g/cc emulsion, 40% ANFO). All tested charges (average densities ranging from 1.20 to 1.36 g/cc) had values less than 1.5 NOx rating. In comparison (see FIG. 15), high density products from emulsion/AN prill blends had values greater than 3. All charges tested in this comparative series (heavy-ANFO vs emulsion) had the same diameter and length configuration. All tested core-explosive charges resulted in a roughly minimum 2× reduction in post-blast fumes when compared to 60/40 blend. Without wishing to be bound to a particular theory, this reduction in post-blast fumes may be attributed to matching velocities of detonation (VODs) of sensitized and unsensitized emulsions compared to the VODs of sensitized emulsion and emulsion/AN prill in blends. This is evaluated further in the following example.

Example 6—Velocity of Detonation of Core-Explosive Emulsions

Figure 16:
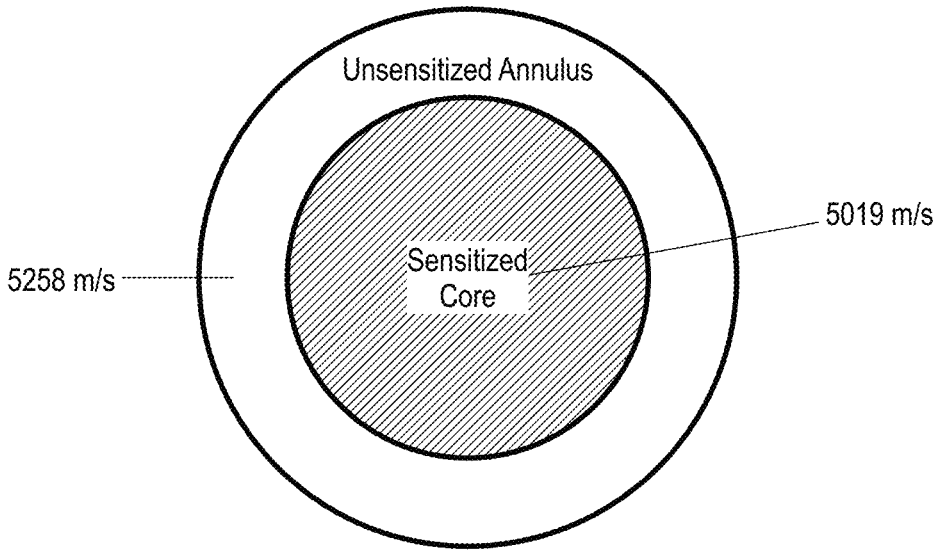
FIG. 16 is a cross-section diagram of an explosive charge tested for velocity of detonation (VOD), showing probe placement and VODs of unsensitized product (0.25 inch into charge, 5258 m/s) and sensitized product (3 inches into product, 5019 m/s).

A total 6-inch diameter charge was made by centering a 4-inch sensitized emulsion product (1.20 g/cc) that was surrounded by unsensitized emulsion (1.36 g/cc), average density was 1.29 g/cc. The product was initiated with a 1-lb cast booster. VOD was recorded using a point-to-point apparatus with a spacing of 5 inches. The charge was submerged in water to provide confinement. FIG. 16 shows a diagram of the charge and the VODs of both sensitized and unsensitized products as measured at the indicated locations. The data suggests that both sensitized and unsensitized products detonated at similar velocities. These similarities in VODs may be a mechanism in reducing NOx as noted at the testing pond. Comparing this to emulsion-ANFO blends suggests a great difference in VODs between the sensitized emulsion and ANFO which may lead to greater NOx formation in those blends.

Example 7—Velocity of Detonation of Core-Explosive Emulsions

Figure 17:
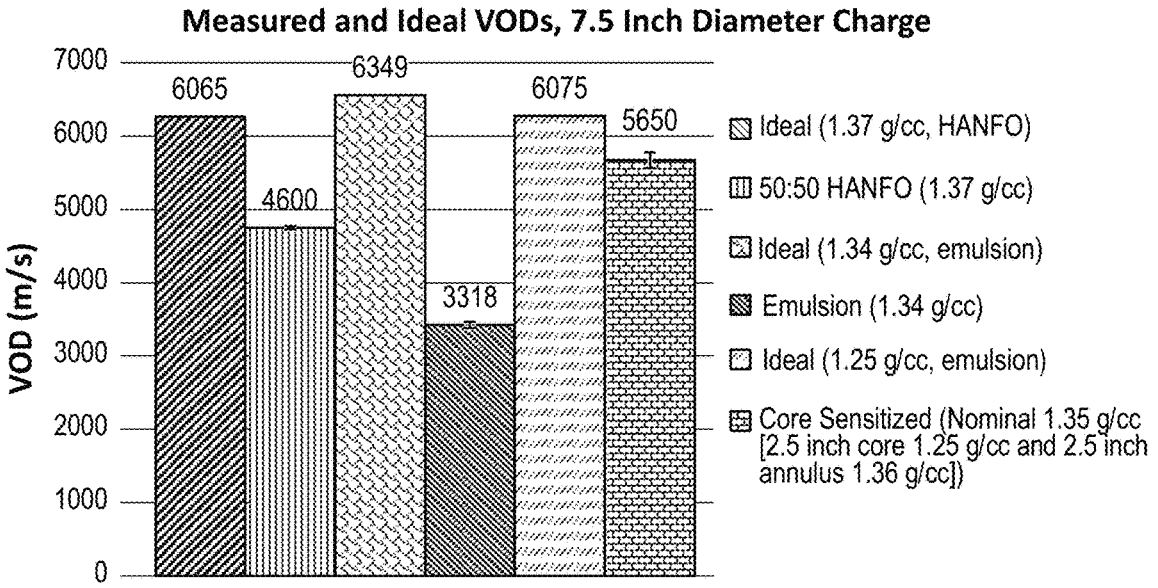
FIG. 17 is a graph comparing measured VOD for a 7.5-inch diameter core-explosive charge to relevant measured and ideal calculated VODs.

A total 7.5-inch diameter charge was made by centering a 2.5-inch sensitized ammonium nitrate emulsion product (1.25 g/cc) that was surrounded by 2.5 inches of unsensitized ammonium nitrate emulsion (1.36 g/cc), providing an average nominal density of 1.35 g/cc for the overall charge. The product was cooled to 5° C. prior to testing. The product was initiated using a 450 NBU booster. VOD was recorded using a MicroTrap™ VOD apparatus recording at 2 MHz. The VOD was recorded on the outer extremity of the charge near the unsensitized portion of the charge. The charge was surrounded with sand to provide confinement. Results are shown in FIG. 17. The VOD was 5650±105 m/s (C.I 95%, $\alpha$=0.05, n=111). With the VOD recorded near the unsensitized portion of the product it demonstrates both sensitized and unsensitized products detonated since the velocity is near ideal calculated VOD (6075 m/s at a 1.25 g/cc density, 93% of ideal VOD). Under the same conditions (7.5-inch diameter, 5° C. cooled temperature, sand confinement) heavy ANFO (heavy ANFO or "HANFO" can refer to a blend of an emulsion and ANFO in which the blend includes greater than 50% ANFO; 1.37 g/cc) had a point-to-point VOD of 4600±16 m/s (C.I 95%, $\alpha$=0.05, n=2); the HANFO at a density of 1.37 g/cc has a calculated ideal VOD of 6065 m/s. Additionally, under the same conditions (7.5-inch diameter, 5° C. cooled temperature, sand confinement) straight emulsion with a density of 1.34 g/cc had a MicroTrap™ VOD of 3318±40 m/s (C.I. 95%, $\alpha$=0.05, n=121), accordingly, emulsion at a density of 1.34 g/cc has a calculated ideal VOD of 6349 m/s. Comparing the generated data to a product with similar density, heavy ANFO (50/50 ammonium nitrate emulsion and ANFO, density=1.36 g/cc), demonstrates the technological superiority of the geometric explosive as described in this example.

Example 8—Velocity of Detonation of Annulus-Explosive Emulsions

Figure 18:
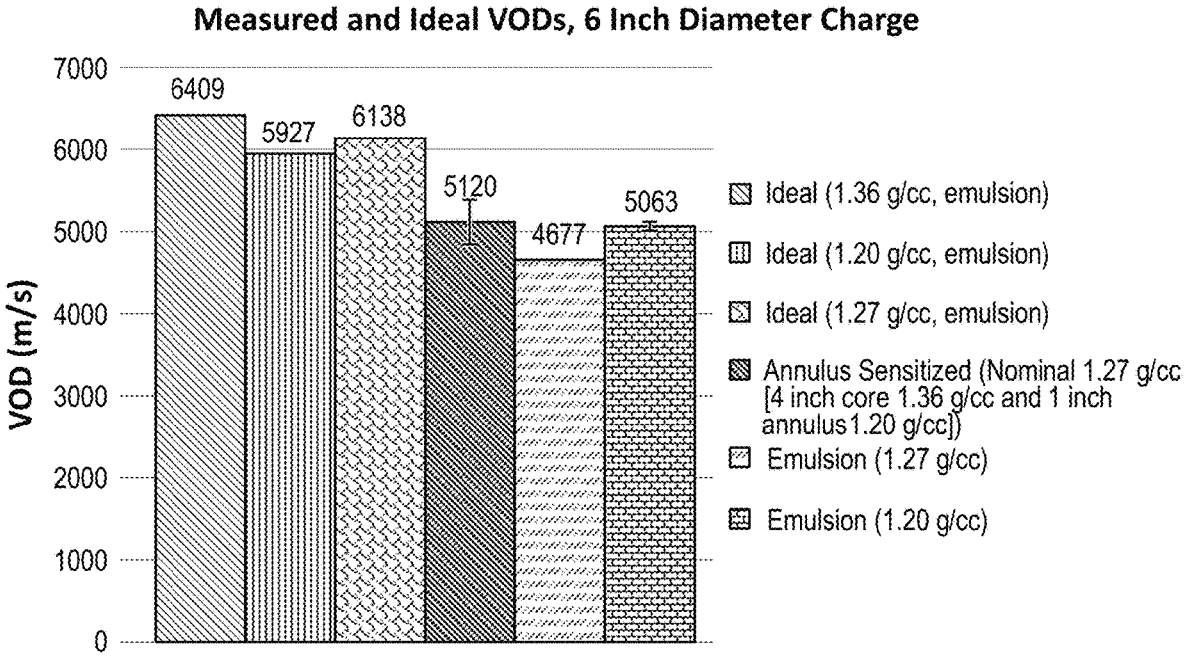
FIG. 18 is a graph comparing measured VOD for a 6-inch diameter annulus-explosive charge to relevant measured and ideal calculated VODs.

A total 6-inch diameter charge was made by centering a 4-inch unsensitized ammonium nitrate emulsion product (1.36 g/cc) that was surrounded by sensitized ammonium nitrate emulsion (1.20 g/cc), providing an average nominal density of 1.27 g/cc for the overall charge. The product was cooled to 5° C. prior to testing. The product was initiated using a 450 NBU booster. VOD was recorded using a point-to-point apparatus. The VOD was recorded on the outer extremity of the charge near the sensitized portion of the charge. The charge was detonated unconfined. As shown in FIG. 18, the charge had a VOD of 5120±260 m/s (C.I 95%, $\alpha$=0.05, n=6). With the VOD recorded near the sensitized portion of the product it demonstrates both sensitized and unsensitized products detonated since the velocity is 86% of ideal VOD (5926 m/s at a 1.20 g/cc density). Under the same conditions (6-inch diameter, 5° C. cooled temperature, unconfined) an emulsion-charge with a density of 1.27 g/cc had a point-to-point VOD of 4677 m/s, which is 76% of ideal calculated VOD (6138 m/s at a 1.27 g/cc density). Comparing the generated annulus-explosive data to a uniformly sensitized product with similar density demonstrates the technological superiority of the annulus-explosive as described in this example.

In the above description of embodiments, various features are sometimes grouped together in a single embodiment, figure, or description thereof for the purpose of streamlining the disclosure. This method of disclosure, however, is not to be interpreted as reflecting an intention that any claim require more features than those expressly recited in that claim. Rather, as the following claims reflect, inventive aspects lie in a combination of fewer than all features of any single foregoing disclosed embodiment.

The claims following this written disclosure are hereby expressly incorporated into the present written disclosure, with each claim standing on its own as a separate embodiment. This disclosure includes all permutations of the independent claims with their dependent claims. Moreover, additional embodiments capable of derivation from the independent and dependent claims that follow are also expressly incorporated into the present written description.

Other embodiments of the invention as described herein are defined in the following paragraphs:

1. A method for loading a bore hole, comprising: providing an energetic material; establishing two streams of the energetic material in which the density of the energetic material differs between the streams, the two streams comprising: a higher density stream; and a lower density stream; delivering the two streams into a bore hole to form a detonable explosive charge comprising a core at least partially surrounded by an annulus, wherein the core is formed by one of the two streams and the annulus is formed by the other of the two streams.
2. The method of paragraph 1, wherein the core is formed from the lower density stream.
3. The method of paragraph 1, wherein the core is formed from the higher density stream.
4. The method of any one of paragraphs 1 to 3, wherein the energetic material is an emulsion.
5. The method of any one of paragraphs 1 to 3, wherein the energetic material is a watergel.
6. The method of any one of paragraphs 1 to 3, wherein the energetic material is a blend of AN prill and an emulsion.
7. The method of any one of paragraphs 1 to 6, comprising establishing the lower density stream by adding a density reducing agent to the energetic material therein.
8. The method of paragraph 7, further comprising establishing the higher density stream by adding less density reducing agent to the energetic material therein than is added to the lower density stream.
9. The method of paragraph 7, wherein no density reducing agent is added to the higher density stream.
10. The method of paragraph 7, wherein the density reducing agent is selected from a chemical gassing agent, a compressed gas, microspheres, AN prill and ANFO.
11. The method of any one of paragraphs 1 to 10, wherein the explosive charge has an average density from about 0.5 g/cc to about 1.6 g/cc.
12. The method of any one of paragraphs 1 to 11, wherein the energetic material in the lower density stream has a density sufficient to render the explosive charge detonable.
13. The method of any one of paragraphs 1 to 12, wherein the energetic material in the lower density stream has a density about 0.05 g/cc to about 0.50 g/cc lower than the density of the higher density stream.
14. The method of any one of paragraphs 1 to 13, further comprising thickening the energetic material in the stream from which the annulus is formed.
15. The method of paragraph 14, comprising thickening the energetic material in both of the streams.
16. The method of any one of paragraphs 1 to 15, wherein a volume ratio of lower density energetic material to higher density energetic material in the explosive charge is about 10% to about 85%.
17. The method of paragraph 16, comprising adjusting a flow rate of at least one of the streams to produce a ratio of the core and annulus.
18. The method of paragraph 17, comprising adjusting the flow rate of both of the streams.
19. The method of any one of paragraphs 1 to 18, wherein the explosive charge has a greater total mass than an equivalent volume of the energetic material in the lower density stream alone.

20. The method of any one of paragraphs 1 to 19, wherein the bore hole has a diameter of about 4 inches to about 20 inches.
21. The method of paragraph 20, wherein the bore hole has a diameter of about 10 inches to about 15 inches.
22. The method of paragraph 20, wherein the bore hole has a diameter of about 4 inches to about 10 inches.
23. The method of paragraph 20, wherein the bore hole has a diameter of about 15 inches to about 20 inches.
24. The method of any one of paragraphs 1 to 19, wherein the bore hole has a diameter of about 2 inches to about 10 inches.
25. The method of any one of paragraphs 1 to 24, wherein the annulus extends around at least 50% of a perimeter of the core.
26. The method of paragraph 25, wherein the annulus extends around about 50% to about 100% of the perimeter of the core.
27. The method of paragraph 26, wherein the annulus extends around about 65% to about 100% of the perimeter of the core.
28. The method of any one of paragraphs 1 to 27, wherein delivering the two streams into the bore hole comprises: introducing into the bore hole a conduit configured to convey the streams in a coaxial configuration, comprising a core flow path and annular flow path; and conveying one of the two streams down the core flow path and the other of the two streams down the annular flow path.
29. The method of any one of paragraphs 1 to 27, wherein delivering the two streams into the bore hole comprises: introducing into the bore hole a tubular liner having a diameter smaller than that of the bore hole; conveying one of the streams within the tubular liner and into the bore hole; and conveying the other stream outside the tubular liner and into the bore hole.
30. The method of any one of paragraphs 1 to 27, wherein establishing the two streams comprises: introducing into the bore hole a conduit having a distal end; and conveying the energetic material through the conduit, wherein the conduit is configured to divide the energetic material near the distal end to establish the two streams.
31. A packaged explosive charge, comprising: a packaging material formed into a container; an energetic material contained within the container, and comprising a core of the energetic material having a first density at least partially surrounded by an annulus of the energetic material having a second density that is different from the first density.
32. The packaged explosive charge of paragraph 31, wherein the first density is lower than the second density.
33. The packaged explosive charge of paragraph 31, wherein the first density is higher than the second density.
34. The packaged explosive charge of any one of paragraphs 31 to 33, wherein the energetic material is an emulsion.
35. The packaged explosive charge of any one of paragraphs 31 to 33, wherein the energetic material is a watergel.
36. The packaged explosive charge of any one of paragraphs 31 to 33, wherein the energetic material is a blend of AN prill and an emulsion.
37. The packaged explosive charge of any one of paragraphs 31 to 36, wherein the energetic material having the lower density comprises a density reducing agent.
38. The packaged explosive charge of paragraph 37, wherein the energetic material having the higher density comprises the density reducing agent in a lower amount than the energetic material having the lower density.
39. The packaged explosive charge of paragraph 37 or 38, wherein the density reducing agent is selected from a chemical gassing agent, a compressed gas, microspheres, AN prill and ANFO.
40. The packaged explosive charge of any one of paragraphs 31 to 39, wherein the packaging material comprises one or more of polypropylene, polyethylene, polyvinyl chloride, polyvinylidene chloride, nylon, polyacrylonitrile, polyethylene terephthalate, polybutadiene, polycaprolactam, polyurethanes, natural rubber, synthetic rubber, polyepoxide resin, kraft paper, cotton, burlap, jute, sisal, and hemp.
41. The packaged explosive charge of any one of paragraphs 31 to 40, wherein the average density of the energetic material is about 0.5 g/cc to about 1.6 g/cc.
42. The packaged explosive charge of any one of paragraphs 31 to 41, wherein the annulus extends around at least 50% of a perimeter of the core.
43. The packaged explosive charge of paragraph 42, wherein the annulus extends around about 50% to about 100% of the perimeter of the core.
44. The packaged explosive charge of paragraph 43, wherein the annulus extends around about 65% to about 100% of the perimeter of the core.
45. A system for loading a geometric configuration of energetic material into a bore hole, comprising: a source of an energetic material; a conduit fluidically connected to the source and configured to convey at least two independent parallel streams of energetic material from the source, said conduit comprising: a core flow path; and an annular flow path, wherein the core flow path is smaller in diameter than the annular flow path and is situated within the annular flow path; and a flow rate control mechanism for varying a flow rate of energetic material in at least one of the core flow path and the annular flow path.
46. The system of paragraph 45, wherein the flow rate control mechanism comprises at least one valve operably connected to at least one of the core flow path and the annular flow path.
47. The system of paragraph 46, comprising at least one valve operably connected to the core flow path.
48. The system of paragraph 46, comprising at least one valve operably connected to the annular flow path.
49. The system of paragraph 46, wherein the at least one valve is a throttling valve selected from pinch valve, diverter valve, diaphragm valve, butterfly valve, and globe valve.
50. The system of paragraph 46, wherein the at least one valve provides degrees of flow restriction ranging from substantially no restriction of flow to substantially complete stoppage of flow.
51. The system of paragraph 45, wherein the flow rate control mechanism comprises at least one pump operably connected to at least one of the core flow path and the annular flow path.
52. The system of any one of paragraphs 45 to 51, comprising a flow divider connecting the source to the flow paths and configured to receive a source stream of energetic material from the source and proportionally divide the source stream to form the at least two independent parallel streams.

53. The system of paragraph 52, wherein the flow divider is incorporated into the conduit and is situated near a distal end of the conduit.

54. The system of any one of paragraphs 45 to 53, wherein the conduit is configured for insertion into a bore hole and for ejecting the streams of energetic material into the bore hole to form therein an explosive charge comprising a core formed by material from the core flow path at least partially surrounded by an annulus formed by material from the annular flow path.

55. The system of paragraph 54, wherein the conduit comprises a hose comprising an outer tube providing the annular flow path and an inner tube providing the core flow path.

56. The system of paragraph 54 or 55, wherein the conduit comprises an end structure adapted for ejecting the streams of energetic material into the bore hole.

57. The system of any one of paragraphs 45 to 56, further comprising a sensitizing subsystem configured for supplying a density reducing agent and introducing the density reducing agent into at least one of the two streams of energetic material.

58. The system of paragraph 57, wherein the sensitizing subsystem is configured for introducing the density reducing agent into both of the two streams of energetic material.

59. The system of paragraph 58, wherein the sensitizing subsystem is configured for introducing the density reducing agent into the two streams of energetic material at independent rates.

60. The system of any one of paragraphs 57 to 59, wherein the sensitizing subsystem is fluidically connected to one of the flow paths upstream of the flow rate control mechanism.

61. The system of any one of paragraphs 57 to 59, wherein the sensitizing subsystem is fluidically connected to one of the flow paths downstream of the flow rate control mechanism.

62. The system of any one of paragraphs 57 to 61, wherein the sensitizing subsystem comprises a sensitizer conduit fluidically connected to one of the flow paths.

63. The system of any one of paragraphs 45-52 or 54-62, wherein the source comprises a separate reservoir for supplying each of the two independent parallel streams of energetic material.

64. The system of any one of paragraphs 45 to 63, further comprising a homogenizer fluidically connected to at least one of the flow paths.

65. The system of any one of paragraphs 45 to 64, further comprising an additive system configured for supplying an additive and introducing the additive into at least one of the two streams of energetic material.

66. The system of paragraph 65, wherein the additive is selected from one or more of inhibitors, lubricants, cross-linkers, bulking agents and thickeners.

67. A mobile manufacturing unit comprising the system of any one of paragraphs 45 to 66.

Without further elaboration, it is believed that one skilled in the art can use the preceding description to utilize the invention to its fullest extent. The claims and embodiments disclosed herein are to be construed as merely illustrative and exemplary, and not a limitation of the scope of the present disclosure in any way. It will be apparent to those having ordinary skill in the art, with the aid of the present disclosure, that changes may be made to the details of the above-described embodiments without departing from the underlying principles of the disclosure herein. In other words, various modifications and improvements of the embodiments specifically disclosed in the description above are within the scope of the appended claims. Moreover, the order of the steps or actions of the methods disclosed herein may be changed by those skilled in the art without departing from the scope of the present disclosure. In other words, unless a specific order of steps or actions is required for proper operation of the embodiment, the order or use of specific steps or actions may be modified. The scope of the invention is therefore defined by the following claims and their equivalents.

What is claimed is:

1. A method for loading a bore hole, comprising:

providing an energetic material;

establishing two streams of the energetic material in which the density of the energetic material differs between the streams, the two streams comprising:

a higher density stream; and a lower density stream;

delivering the two streams into a bore hole to form a detonable explosive charge comprising a core at least partially surrounded by an annulus, wherein the core is formed by one of the two streams and the annulus is formed by the other of the two streams, and wherein the annulus extends around at least 50% of a perimeter of the core in the detonable explosive charge.

2. The method of claim 1, wherein the core is formed from the lower density stream.

3. The method of claim 1, wherein the core is formed from the higher density stream.

4. The method of claim 1, wherein the energetic material is an emulsion.

5. The method of claim 1, wherein the energetic material is a watergel.

6. The method of claim 1, wherein the energetic material is a blend of AN prill and an emulsion.

7. The method of claim 1, comprising establishing the lower density stream by adding a density reducing agent to the energetic material therein.

8. The method of claim 7, further comprising establishing the higher density stream by adding less density reducing agent to the energetic material therein than is added to the lower density stream.

9. The method of claim 7, wherein the density reducing agent is selected from a chemical gassing agent, a compressed gas, microspheres, AN prill and ANFO.

10. The method of claim 1, wherein the explosive charge has an average density from about 0.5 g/cc to about 1.6 g/cc.

11. The method of claim 1, wherein the energetic material in the lower density stream has a density sufficient to render the explosive charge detonable.

12. The method of claim 1, wherein the energetic material in the lower density stream has a density about 0.05 g/cc to about 0.50 g/cc lower than the density of the higher density stream.

13. The method of claim 1, further comprising thickening the energetic material in the stream from which the annulus is formed.

14. The method of claim 1, wherein delivering the two streams into the bore hole comprises:

introducing into the bore hole a conduit configured to convey the streams in a coaxial configuration, comprising a core flow path and annular flow path; and conveying one of the two streams down the core flow path and the other of the two streams down the annular flow path.

15. The method of claim 1, wherein delivering the two streams into the bore hole comprises:

introducing into the bore hole a tubular liner having a diameter smaller than that of the bore hole;

conveying one of the streams within the tubular liner and into the bore hole; and conveying the other stream outside the tubular liner and into the bore hole.

16. A method for loading a bore hole, comprising:

providing an energetic material;

establishing two streams of the energetic material in which the density of the energetic material differs between the streams, the two streams comprising:

a higher density stream; and a lower density stream, wherein the higher density stream is established by adding less density reducing agent to the energetic material therein than is added to the lower density stream, and wherein the energetic material in the lower density stream has a density about 0.05 g/cc to about 0.50 g/cc lower than the density of the higher density stream;

delivering the two streams into a bore hole to form a detonable explosive charge comprising a core at least partially surrounded by an annulus, wherein the core is formed by one of the two streams and the annulus is formed by the other of the two streams, and wherein the annulus extends around at least 50% of a perimeter of the core in the detonable explosive charge.

17. The method of claim 16, wherein a volume ratio of lower density energetic material to higher density energetic material in the explosive charge is about 10% to about 85%.

18. The method of claim 16, comprising adjusting a flow rate of at least one of the streams to produce a ratio of the core and annulus.

* * * * *